US006089991A

United States Patent [19]

Yeh

[11] Patent Number: 6,089,991

[45] Date of Patent: Jul. 18, 2000

[54] GOLF CLUB

[76] Inventor: Wang-Chiu Yeh, No. 34, Feng-Hua Street, Hua-Mei Tsun, Niao-Sang Hsiang, Kaohsiung Hsien, Taiwan

[21] Appl. No.: 09/231,084

[22] Filed: Jan. 14, 1999

[51] Int. Cl.[7] ..... A63B 53/02

[52] U.S. Cl. ..... 473/305; 473/312

[58] Field of Search ..... 473/305–315

[56] References Cited

U.S. PATENT DOCUMENTS 2,171,483 8/1939 Simonton .
4,607,846 8/1986 Perkins .
5,039,098 8/1991 Pelz .
5,137,275 8/1992 Nelson .
5,388,827 2/1995 Reynolds .
5,540,435 7/1996 Kawasaki .

*Primary Examiner*—Sebastiano Passaniti
*Attorney, Agent, or Firm*—Birch, Stewart, Kolasch & Birch, LLP

[57] ABSTRACT

An improved golf club mainly comprises: a club head having a through hole in its club neck for accommodating a tapped club shaft, wherein insert portion of the club shaft is glued on its outer surface for sticking at the club neck; a bolt with thread portion glued being used to screw in and joined with the club shaft for dual assurance of a firm connection without detachment of the club head in a striking, meanwhile, the bolt being replaceable for balance adjustment of the club head.

8 Claims, 2 Drawing Sheets

GOLF CLUB

BACKGROUND OF THE INVENTION

This invention relates to an improved golf club, particularly to a golf club with an enhanced firm joint between the shaft and the head that can not be detached easily when striking, and balance of the golf club may be adjusted to some extent for meeting user's requirements.

The shaft portion of a common golf club (as shown in FIG. 1) is usually glued then plugged in a cave formed in the head. Such a combination manner may derive some defects upon striking, such as:

(1) Dropping off, or loosening of the club head that may fly to hit someone when striking.

(2) Difficult to keep the neck of the club head in position without displacement owing to improper striking.

(3) Weight distribution of the club head unadjustable.

(4) Impairment to club heel. As the toe of the club head is usually cocked when striking, the club heel may be impaired when hitting on the ground (as shown in FIG. 2).

In view of the above imperfections, the inventor is benefited with years of manufacturing experience in related field to have an improved construction of this invention developed and proposed to provide a firmly jointed golf club at its head and shaft to prevent the head from dropping off and flying to hit people, and also a function of balance adjustment of the club head.

SUMMARY OF THE INVENTION

This invention being characterized in:

1. A through hole is perforated in the neck of the club head for a bolt to penetrate and screw-jointed to the partially tapped club shaft for an enhanced joint of the club head and shaft.

2. A dual fixing measure by gluing and screwing ensures the head of the golf club will not fly away in striking.

3. Bolts in different weights can be used for balance adjustment in the club head according to user's requirements.

BRIEF DESCRIPTION OF THE DRAWINGS

For a better understanding to the present invention, together with further advantages or features thereof, at least one preferred embodiment will be elucidated below with reference to the annexed drawings which are given by way of illustration only, and thus are not limitative of the present invention, and in which.

DETAILED DESCRIPTION OF THE PREFERRED EMBODIMENT

Figure 1:
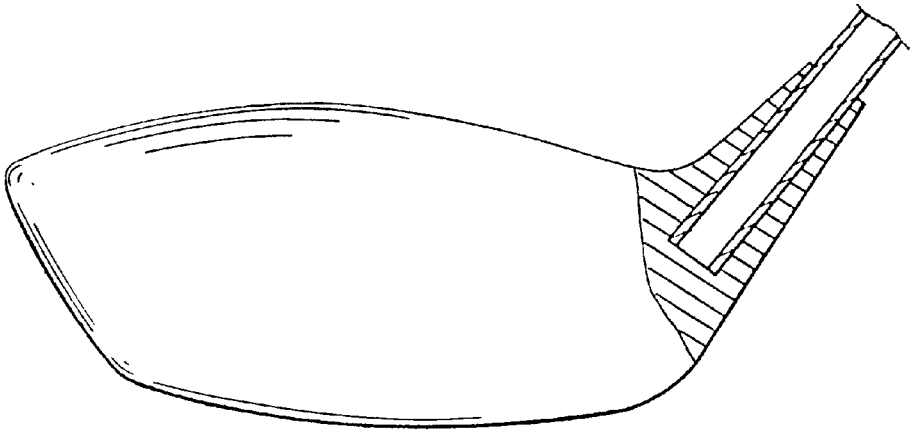
FIG. 1 PRIOR ART
FIG. 1 is a lateral view of a conventional golf club head.
Figure 2:
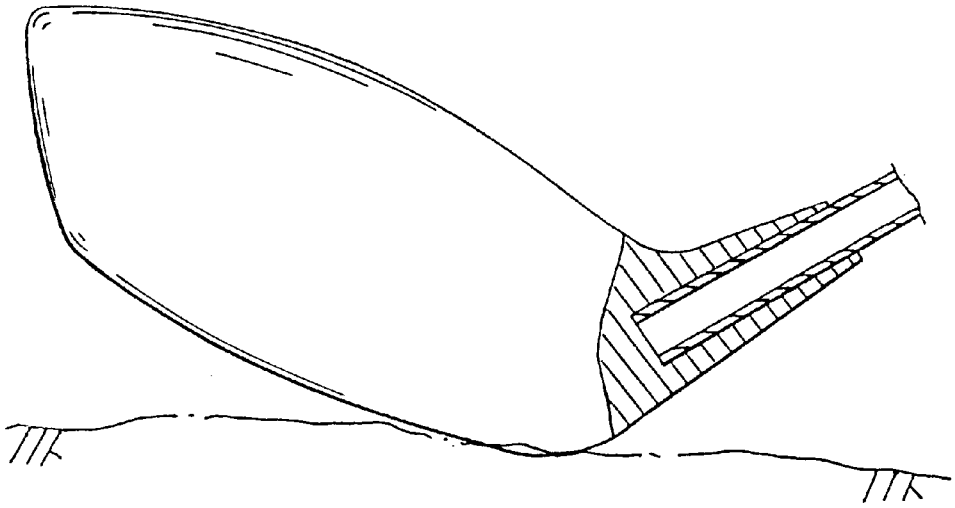
FIG. 2 PRIOR ART
FIG. 2 is a schematic view of a conventional golf club showing possible impairment of club heel when striking at special ground profile.
Figure 3:
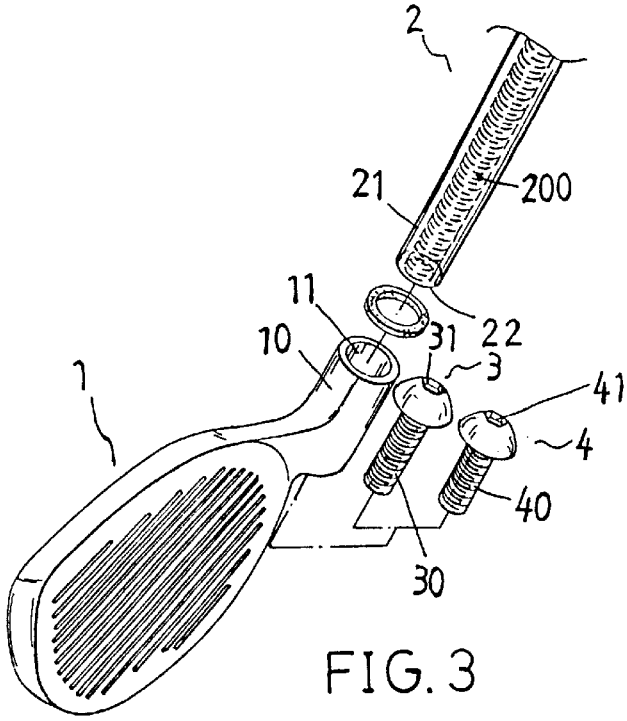
FIG. 3 is an exploded view of this invention.
Figure 4:
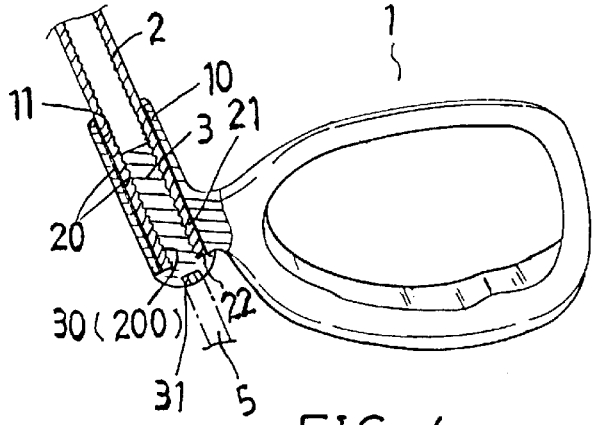
FIG. 4 is a cutaway sectional view showing disposition of a fixing bolt in this invention.
Figure 5:
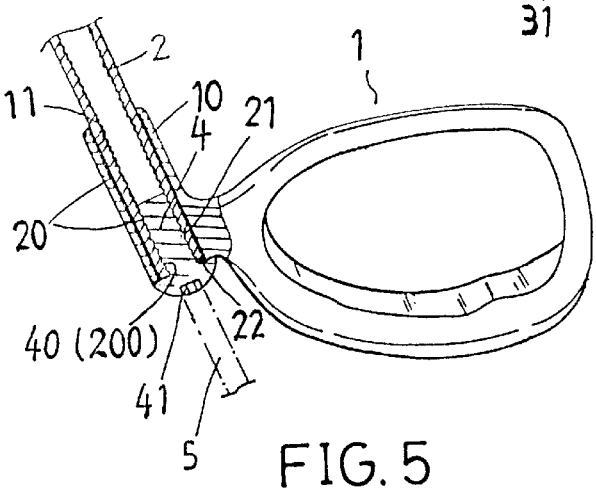
FIG. 5 is another cutaway sectional view showing disposition of a different fixing bolt in this invention.

As shown in FIG. 3, a through hole 11 is formed in a center portion of a golf club neck 10 for insertion of a tapped club shaft 2 with inner threads 200. The insert portion 21 of the shaft 2 is glued 20 for sticking to an inner surface of the club neck 10 before insertion. A bolt 3, which may be replaced by another bolt 4 in different weight, glued on its surface threads 30, 40 is screwed to joint the club shaft 2. Such a dual joint measure, by glue and threads, is to ensure a firm combination of the club head 1 and club shaft 2 to eliminate possibility of loosening or flying away of the club head 1 when striking. Further, this invention also provides a mechanism for balance adjustment of the club head 1 by selection a suitable fixing bolt 3, 4 to be inserted in the club shaft 2 (as shown in FIG. 4, 5).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf club comprising:

a tapped club shaft, the tapped club shaft having an insert portion with an opening at one end thereof;

a club head having a neck with a through hole being formed in a center portion thereof, the through hole in the neck receiving and accommodating the insert portion of the club shaft, the insert portion of the club shaft being coated with glue and adhered to the neck of the club head;

a bolt with a thread portion which is glued and screwed in the club shaft through the through hole in the club head for a dual assurance of a connection of the club shaft and the club neck to prevent the club head from detaching from the shaft upon striking of a golf ball, the bolt being screwed directly to the club shaft such that the bolt is in direct contact with the club shaft, the bolt being selected such that balance of the club head can be adjusted.

2. The golf club according to claim 1, wherein a head of the bolt is exposed at a bottom of the neck when the bolt is screwed into the club shaft.

3. The golf club according to claim 2, wherein the club shaft and insert portion are a one-piece, unitary structure.

4. The golf club according to claim 3, wherein the head of the bolt is in contact with the end of the club shaft.

5. The golf club according to claim 4, wherein the shaft has a longitudinal axis and wherein the bolt is coextensive with the longitudinal axis of the shaft.

6. The golf club according to claim 5, wherein the through hole in the neck of the club head and the opening in the club shaft both have a uniform diameter.

7. The golf club according to claim 1, wherein the club shaft and insert portion are a one-piece, unitary structure.

8. The golf club according to claim 1, wherein the shaft has a longitudinal axis and wherein the bolt is coextensive with the longitudinal axis of the shaft.

* * * * *